US006113292A

United States Patent [19]

Unno et al.

[11] Patent Number: 6,113,292

[45] Date of Patent: Sep. 5, 2000

[54] PRINTER HEAD RELEASE MECHANISM

[75] Inventors: Teruhiko Unno; Akira Hashimoto, both of Suwa; Kenji Watanabe, Tokyo; Takanobu Kameda, Tokyo; Chieko Aida, Tokyo; Tomoyuki Shimmura, Tokyo, all of Japan

[73] Assignee: Seiko Epson Corporation, Tokyo, Japan

[21] Appl. No.: 08/619,691

[22] PCT Filed: Dec. 4, 1995

[86] PCT No.: PCT/JP95/02468

§ 371 Date: Jun. 10, 1998

§ 102(e) Date: Jun. 10, 1998

[87] PCT Pub. No.: WO96/16815

PCT Pub. Date: Jun. 6, 1996

[30] Foreign Application Priority Data

Dec. 2, 1994 [JP] Japan ..... 6-299600

[51] Int. Cl.[7] ..... B41J 13/00

[52] U.S. Cl. ..... 400/578; 400/663

[58] Field of Search ..... 400/578, 54, 55, 400/56, 58, 663, 208, 232, 605, 613, 614.1

[56] References Cited

U.S. PATENT DOCUMENTS

| | | | |
|---|---|---|---|
| 4,914,452 | 4/1990 | Fukawa | 400/613 |
| 5,060,076 | 10/1991 | Curley | 400/613 |
| 5,100,251 | 3/1992 | Yasuoka | 400/605 |
| 5,150,130 | 9/1992 | Sato | 400/613 |
| 5,193,919 | 3/1993 | Godo et al. . | |
| 5,478,159 | 12/1995 | Schneider et al. | 400/232 |
| 5,634,728 | 6/1997 | Nunokawa et al. . | |

FOREIGN PATENT DOCUMENTS

| | | |
|---|---|---|
| 0433063 | 6/1991 | European Pat. Off. . |
| 0487312 | 5/1992 | European Pat. Off. . |
| 0487313 | 5/1992 | European Pat. Off. . |
| 0607023 | 7/1994 | European Pat. Off. . |
| 56-005196 | 2/1981 | Japan . |
| 60-201979 | 10/1985 | Japan . |
| 63-197055 | 7/1988 | Japan . |
| 1160660 | 6/1989 | Japan . |
| 1131545 | 9/1989 | Japan . |
| 1169348 | 11/1989 | Japan . |
| 2024180 | 1/1990 | Japan . |
| 2095878 | 4/1990 | Japan . |
| 2-294817 | 12/1990 | Japan . |
| 3076676 | 4/1991 | Japan . |
| 3-166977 | 7/1991 | Japan . |
| 4-102860 | 9/1992 | Japan . |
| 5026422 | 4/1993 | Japan . |
| 6-198962 | 7/1994 | Japan . |
| 6-227052 | 8/1994 | Japan . |

*Primary Examiner*—Eugene Eickholt
*Attorney, Agent, or Firm*—Hogan & Hartson LLP

[57] ABSTRACT

On printer (20), tape cartridge (4) is detachable relative to mounting unit (5). Mounting unit (5) is covered by cover (22). When cover (22) is closed, its protrusion (51) rotates rotary component (54), and its operating edge (54*b*) moves moving component (55). When operating edge (54*b*) moves over the top edge of surface A of guiding surface (55*a*) of the moving component, the cover is completely closed. Subsequently, rotary component (54) is guided to surface B, where it is held in a coupled state. In conjunction with moving component (55), head carrier component (59) rotates, and head (6) located at the tip of the head carrier component becomes fixed at the print position. In the condition in which a print position is formed, rotary component (54) is off from protrusion (51) of the cover. Therefore, no load acts from the side of head (6) onto the side of cover (22). When cover-opening button (24) is pushed down, rotary component (54) disengages from surface B of the moving component, thus creating a condition in which the head has been released.

12 Claims, 13 Drawing Sheets

PRINTER HEAD RELEASE MECHANISM

BACKGROUND OF THE INVENTION

1. Field of the Invention

This invention relates generally to a printer that is provided with a mounting unit for mounting a cartridge containing a recording medium. More specifically, it relates to a head release mechanism for printers of this form, capable of moving the print head, relative to the recording medium supplied from a mounted cartridge, to the print position and to a release position that is away from the print position.

2. Description of the Related Art

Printers referred to as tape printers and label printers have come into use in recent years. In general, the recording media used on this type of printer are tape-shaped media. The backside of such a recording medium is an adhesive surface covered by a piece of peel-off paper. The recording medium is stored in a cartridge in a spooled form. A cartridge-mounting unit for mounting the cartridge on a detachable basis is formed on the printer side. The cartridge-mounting unit is covered by a cover and is configured in such a way that one opens the cover to mount a cartridge, closes the cover, and then performs printing.

A head release mechanism is incorporated into the printer so that the print head that prints on the recording medium supplied from the mounted cartridge is not damaged when the cartridge is attached or detached and so that the print head does not hinder the cartridge attaching or detaching operation. The head release mechanism moves the print head from the print position, protruding to the recording medium side, to the release position, which is away from the print position.

FIG. 11A shows a conventional printer called a tape printer. As indicated in the figure, the first half of the top portion of printer 1 is keyboard 2. The second half is opening/closing cover 3. When cover 3 is opened, as illustrated in the figure, mounting unit 4 for tape cartridge 4 (see FIG. 11B) formed inside the cover comes into view. Head unit 7, with a built-in thermal head 6 as a print head, is provided on mounting unit 5. As shown in FIG. 12, tape cartridge 4 holds, in its case 41, roll 8 for tape-form recording medium T and roll 9 for ink ribbon R. A transport path is formed so that these items become stacked at the position in which they pass through platen roll 42.

Formed adjacent to platen roll 42 is a head unit insertion hole 43 through which head unit 7 is inserted when a tape cartridge is mounted. Thermal head 6, which is incorporated in head unit 7 that is inserted into hole 43, can be moved by the head release mechanism built into the printer, from the print position (indicated by the solid line in the figure) protruding to the side of platen roll 42 to the release position (indicated by dashed lines in the figure) that is located in the back.

The conventional head release mechanism basically comprises a head carrier component that supports thermal head 6 to allow the thermal head to move from the print position to the release position, a spring component that always holds the component onto the side of the head release position, a moving component that moves the head carrier component to the print position against the spring force of the spring component, and a locking component that locks the head carrier component, that has moved to the print position, in the new position. The head release mechanism of this composition is incorporated into the backside of the cartridge-mounting unit.

In printer 1 shown in FIG. 11A, the moving component that moves thermal head 6 to the print position is protrusion 31 that is formed on the backside of cover 3. When cover 3 is closed, protrusion 31 intrudes into hole 11, formed on the case side, and moves the internally provided head carrier component toward the print position against the spring force. Therefore, when cover 3 is closed, against the spring force, the head carrier component is moved by protrusion 31 in conjunction with the closing operation. This causes head 6, held at that location, to protrude into the print position. When cover 3 is completely closed, hook 32, formed on the front edge of cover 3, is inserted into hole 12, that is formed on the case side. The hook couples with the hook engagement unit formed in the interior of the hole. This causes the cover to be locked in the closed condition. Thus, the head carrier component is locked into the print position.

To open cover 3, one operates cover-opening button 13. Operating button 13 releases the lock and opens cover 3. As a result, the head carrier component released from protrusion 31 of cover 3 is returned to the release position by the spring force. Therefore, thermal head 6 is retracted to the release position inside head unit 7. In this manner, opening cover 3 automatically creates a condition in which the head is released, thus permitting tape cartridge replacement and similar operations.

In the head release mechanism of this form, protrusion 31 formed integrally on cover 3, presses head 6 onto the print position, and hook 32, formed integrally on cover 3 maintains the print state. Therefore, the pressing force that presses the head onto the print position always acts on cover 3. Further, since the head load acts directly on cover 3, the head load is controlled by cover 3.

On the other hand, head release mechanisms that are not tied to the opening and closing actions of cover 3 are in the public domain. For example, as shown in FIG. 13, a release lever 14 is placed at a position that becomes exposed when cover 3 is opened. This release lever 14 is movable from a position over tape cartridge 4, that is mounted and centered at one end of the release lever, to a position away from that position. By moving lever 14 to a position above tape cartridge 4, one can move head 6 to the print position. By moving the head from that position to the position indicated by the solid line in the figure, one can retract head 6 to the release position.

In a head release mechanism in which the opening and closing actions of cover 3 are separate from the head release operation, the tape cartridge could be replaced inadvertently even when the head is not released (i.e., when the head is still at the print position). However, if the head is at the print position, lever 14 is at a position that hinders the tape cartridge replacement operation. This prevents the occurrence of the problem mentioned above. The use of this mechanism, however, always requires a lever operation for releasing the head or for setting the head in the print position, in addition to the operation of opening and closing cover 3.

The conventional head release mechanism described above contains the following problems that must be addressed:

First, in a form in which a head release mechanism is constructed using a cover, a protrusion formed on the cover itself presses the head onto the print position. Therefore, the pressing force directly acts on the cover. Since load is always acting on the cover, the cover itself is liable to deform. When a deformation occurs, the head load changes with the result that the head release mechanism can potentially lose its ability to correctly position the head in the print position.

On the other hand, in the form in which the cover and the head release mechanism are completely separate, the release lever must be operated in order to release the head and press it onto the print position as separate from the operation of opening and closing the cover. While it facilitates controlling the head load or the head position, this requires a lever operation each time the tape cartridge is attached or detached, thus adding to operational complexity.

SUMMARY OF THE INVENTION

The purpose of the present invention is to provide a head release mechanism for a printer in which load does not act on the cover from the print head.

Also, the present invention aims to provide a head release mechanism for a printer capable of moving a print head to a release position in conjunction with the operation of opening the cover.

Further, the present invention aims to provide a head release mechanism for a printer in which load does not act on the cover from the print head and also the printer head can be moved to release and print positions in conjunction with the operation of opening and closing the cover.

In order to solve the above problems, the printer head release mechanism of the present invention releases the head and moves it to the print position, in conjunction with the operation of opening and closing the cover, and adopts a constitution in which, after the head has been moved to the print position, the head load does not directly act on the cover.

That is, in a printer comprising a cartridge-mounting unit that detachably mounts a cartridge containing a recording medium, a cover that covers the cartridge-mounting unit, a cover-opening button for opening the cover, a print head that prints on the recording medium supplied from the cartridge attached to said cartridge-mounting unit, and a head release mechanism that moves the print head to the print position at which printing is performed on the recording medium and to a release position that is removed from the print position, this head release mechanism according the present invention includes a moving mechanism that operates in conjunction with the operation for closing said cover and that moves said print head from said release position toward said print position; a locking mechanism that, when said print head has reached said print position, releases the coupling between said moving mechanism and said cover and that locks said print head in said print position; and an unlocking mechanism that operates in conjunction with the operation of said cover-opening button, that releases the locking by said locking mechanism, and that forms a coupled state between said moving component and said cover.

When the cover is closed and in conjunction with the closing operation, the print head in the head release mechanism of the present invention moves from the release position toward the print position. When the print head has reached the print position, the moving that moves the print head is detached from the cover and the print head is locked in the print position by the locking mechanism. Therefore, the operation of moving the print head to the print position can be performed in conjunction with the operation of closing the cover. Further, in a condition in which the print head is locked in the print position, the mechanical link between the cover and the print head is released. In this state, therefore, load does not act on the cover side, thus preventing any deformation of the cover itself or any change in the head load. This ensures accurate locking, by the locking mechanism, of the print head in the print position.

In a preferred embodiment of the present invention, the mechanism described above are constituted as follows: first, said moving mechanism can comprise a protrusion that is formed on said cover; a rotary component that operates in conjunction with said cover-closing operation and in which the protrusion coupling end formed by said protrusion on one edge is pushed and in which the operating edge on the other end can rotate from the first position to the location immediately before the second position; a head carrier component that moves said thermal head from said release position to said print position when the head carrier component is pressed upon by the operating edge of the rotary component and when said operating edge moves from said first position to the second position; and a head release spring component that energizes the head carrier component in a direction so that said thermal head is always at said release position.

The locking means described above can be provided with a guide-holding surface formed on the coupling surface on which the operating edge of said rotary component in said head carrier component is coupled. The operating edge of said rotary component rotates to a location immediately preceding said second position, said guide-holding surface uses the spring force of said head release spring component to guide the operating edge so that it rotates to the second position and disengages said rotary component and said protrusion. The guide-holding surface is set in a shape that enables it to maintain the operating edge of said rotary component that has reached said second position at the second position through the use of the spring force of said head release spring component.

Further, the unlocking mechanism described above can be provided with an unlocking surface formed on said cover-opening button. When said cover-opening button is operated, the unlocking surface forcibly moves the operating edge of said rotary component over said guide-holding surface from said second position toward said first position against the spring force of said head release spring component.

In the preferred embodiment of the present invention thus constituted, the cover remains open when the print head is at the release position, and the operating edge of the rotary component is at the first position. Further, the head carrier component that carries the head is energized by the head release spring component and is positioned in such a way that the head is in the release position. When the cover is closed, the protrusion that is formed there pushes and rotates the rotary component and moves its operating edge from the first position to a location immediately preceding the second position. The head carrier component moves in conjunction with this rotation and moves the head toward the print position. When the operating edge has rotated to a location immediately preceding the second position, the operating edge, guided by the guide-holding surface formed on the head carrier component, moves to the second position and is locked there. As a result, the protruding engagement edge on the rotary component separates from the protrusion on the cover, and the side of the head carrier component is locked into the print position. Consequently, the print head is held at the print position by the coupling between the operating edge of the rotary component and the guide-holding surface of the head carrier component. Therefore, the load from the print head never directly acts on the protrusion that is formed on the side of the cover.

On the other hand, when the cover-opening button is operated, the unlocking surface formed on the button causes the operating edge of the rotary component to disengage from the print head of the head carrier component, thus making the rotary component rotatable toward the first direction. As a result, the print head moves to the release position due to the spring force of the rotary spring component, and the cover opens.

In this manner, the head moves to the print position and the release operation is performed in conjunction with the operation of opening and closing the cover. Further, when the head is fixed in the print position, the protrusion on the cover is removed from the rotary component side, and is set in a condition wherein the head load does not act.

The present invention employs the following structure such that load does not act on the cover from the printer head and the printer head can be moved to the release position in conjunction with the operation of opening the cover.

In a printer comprising a cartridge-mounting unit that detachably mounts a cartridge containing a recording medium, a cover that covers the cartridge-mounting unit, a cover-opening button for opening the cover, a print head that prints on the recording medium supplied from the cartridge attached to said cartridge-mounting unit, and a head release mechanism that moves the print head to the print position at which printing is performed on the recording medium and to a release position that is removed from the print position, said head release mechanism includes said cover-opening button capable of moving between a cover locked position at which said cover is kept locked and a cover open position at which the cover separated apart from the cover locked position by a certain distance is unlocked, a holder mechanism for holding the cover-opening button at each of said cover locked position and cover open positions, a print head support mechanism for movably supporting said print head at said print position and said release position, and a moving mechanism for moving said print head support mechanism to a position at which said print head is set in said release position in conjunction with the movement of said cover-opening button from said cover locked position to said cover open position.

In a head release mechanism in this structure, the cover-opening button works as a head release button. That is, when the cover opening button is moved to the cover open position, the moving means moves the print head support means in conjunction with the movement such that the print head is set to the release position. The holder means allows the cover-opening button to be held at the cover locked position and the cover open position. Accordingly, the holder means receives load from the print head, and thus load does not act on the cover.

BRIEF EXPLANATION OF THE DRAWINGS

FIG. 8A is a schematic diagram showing a locked state and FIG. 8B is a schematic diagram showing an unlocked state;

FIG. 11A shows an external view of the printer and FIG. 11B shows an external view of a tape cartridge mounted onto the printer;

DESCRIPTION OF THE PREFERRED EMBODIMENTS

The following is an explanation of preferred embodiments of the present invention with reference to drawings.

Preferred Embodiment 1

Figure 1:
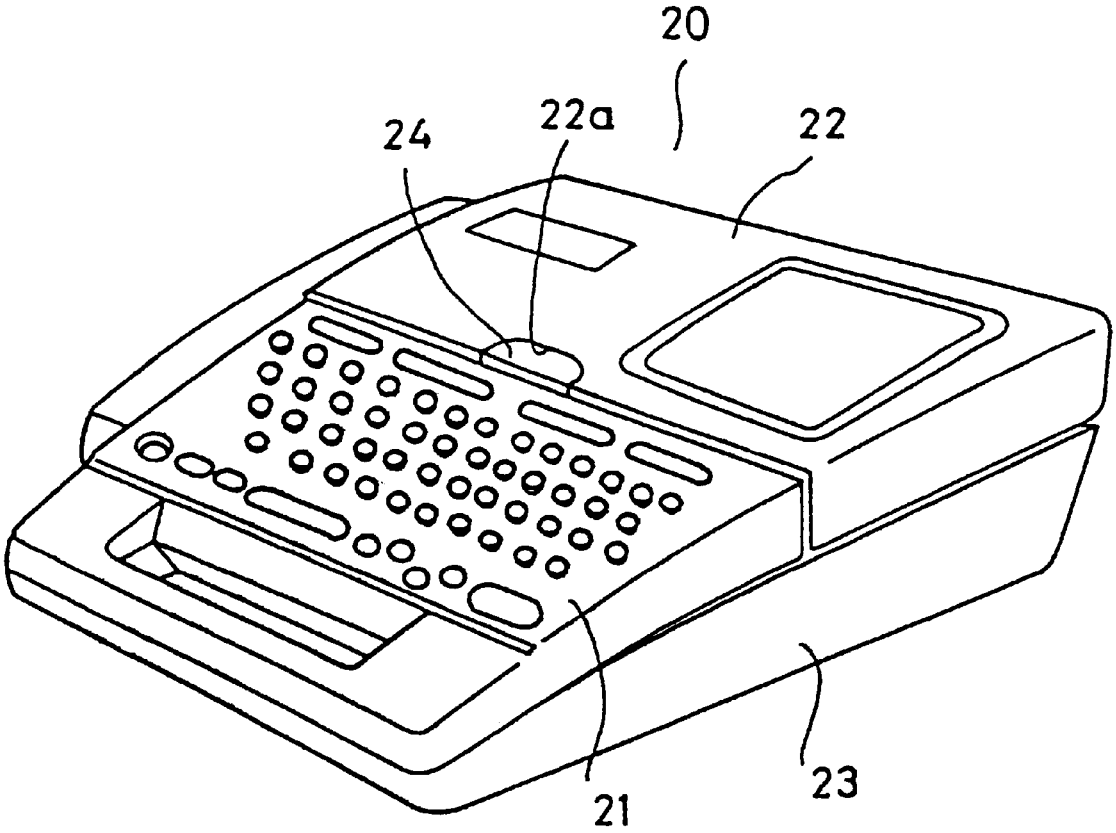
FIG. 1 shows an external view of the printer to which the present invention is applied.

FIG. 1 shows a printer to which the head release mechanism of the present invention is applied. The printer in this example is a tape printer as described in the section on prior art, wherein printing is performed on a tape-form recording medium, on the underside of which an adhesive surface is formed. After the printing is completed, the printed recording medium can be cut to a specified length. The recording medium, which has been cut to a prescribed length, can be affixed to a desired location by peeling off the peel-off paper on the bottom so as to expose the adhesive surface.

As shown in FIG. 1, the overall configuration of printer 20 of this example is the same as that of a conventional printer. The first half of the top portion of the printer is keyboard component 21. Cover 22 is attached to the second half. A U-shaped cut-out 22*a* is made at the center of the front edge of cover 22, at which cover-opening button 24, placed on the side of printer system unit 23, is positioned.

Figure 2:
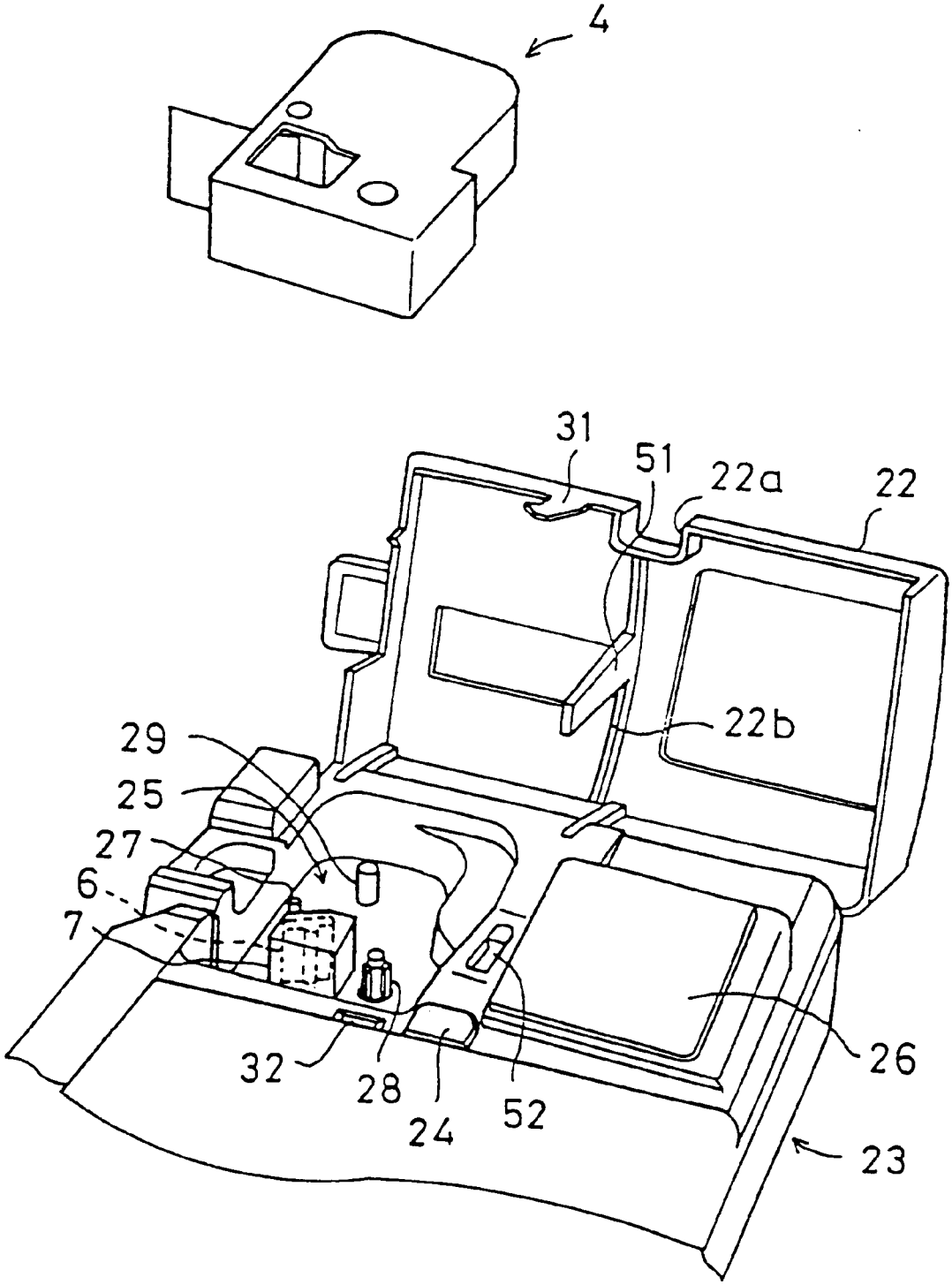
FIG. 2 is an enlarged perspective view of the printer of FIG. 1 with its cover ajar.
Figure 11A:
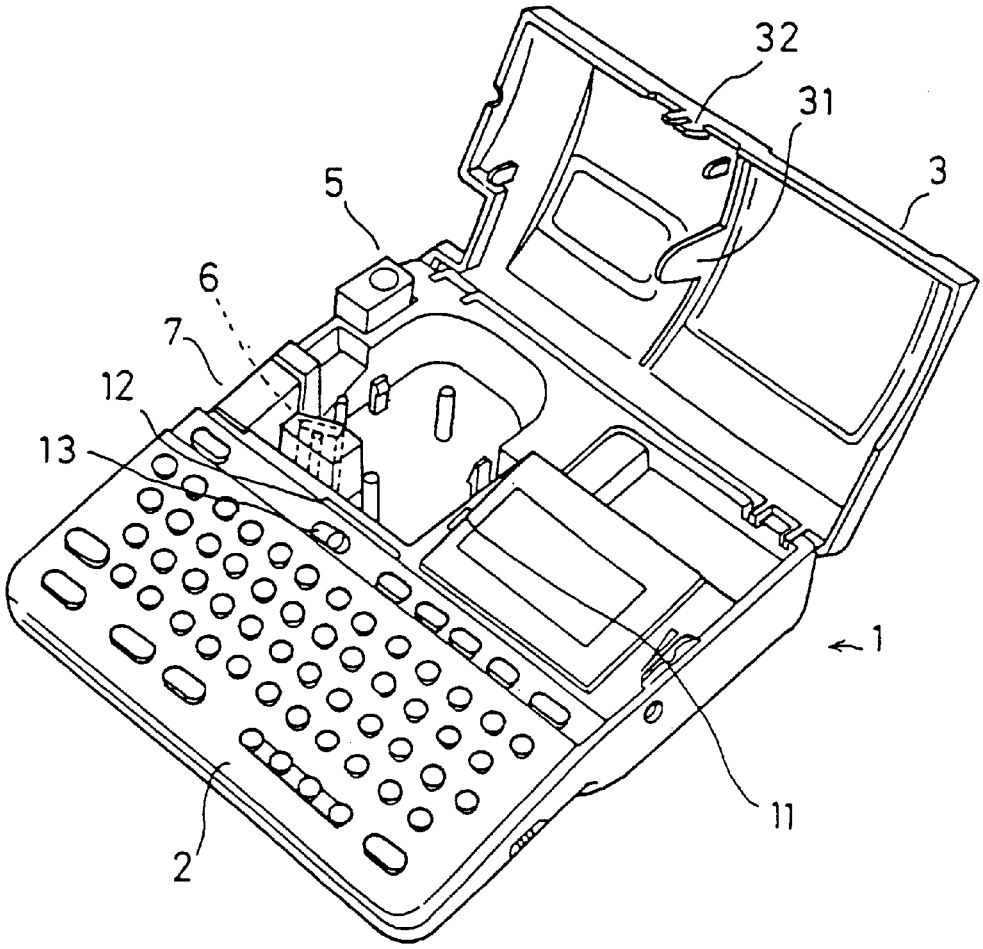
Fig. 11A (PRIOR ART)
FIGS. 11A and 11B illustrate a conventional printer head release mechanism in which specifically.
Figure 11B:
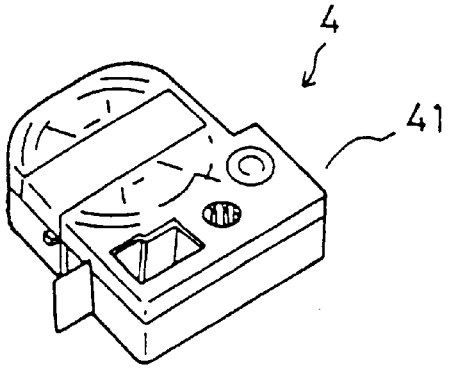
Fig. 11B (PRIOR ART)
Figure 12:
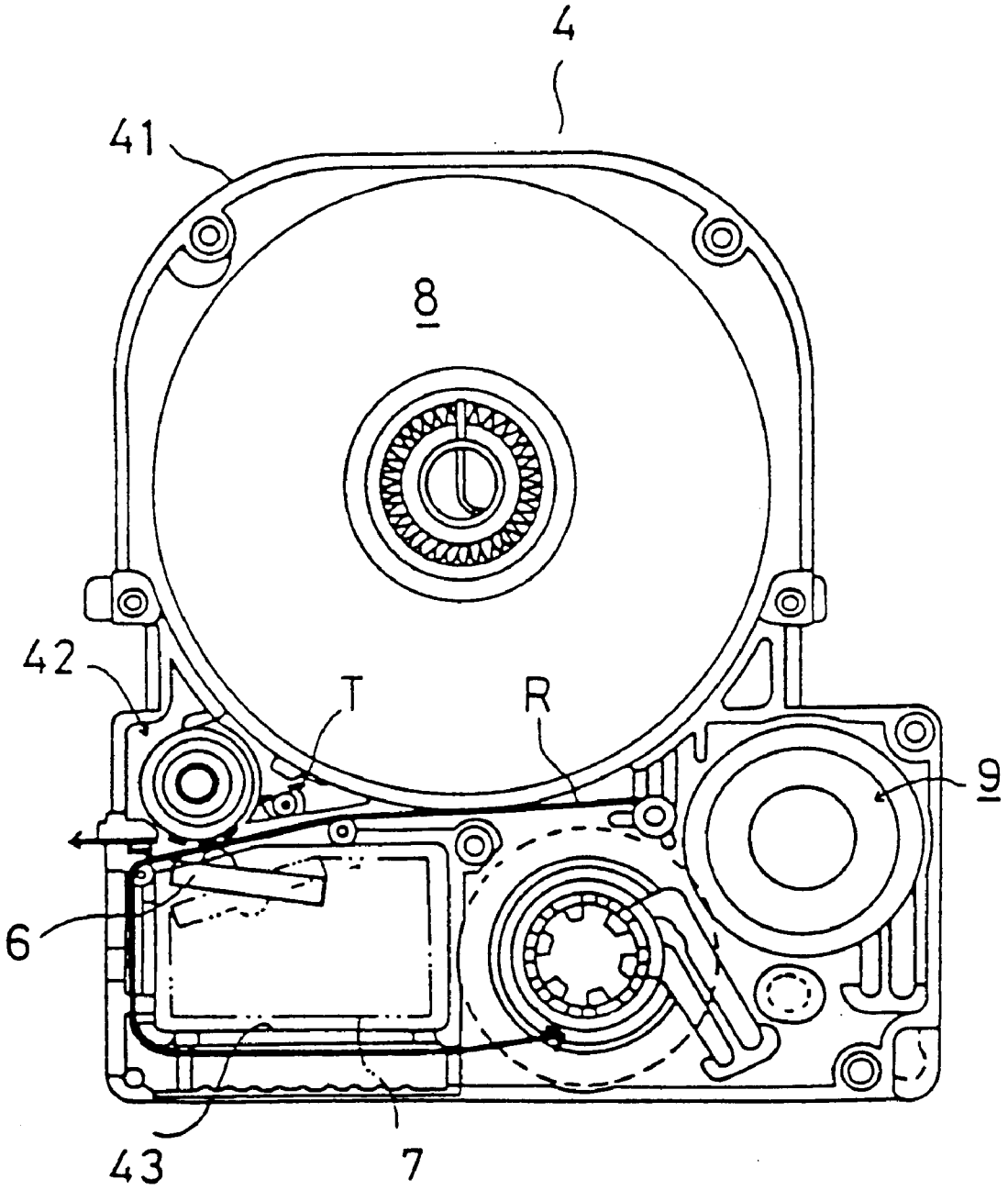
Fig. 12 (PRIOR ART)
FIG. 12 is a schematic diagram showing an internal structure of a tape cartridge.
Figure 13:
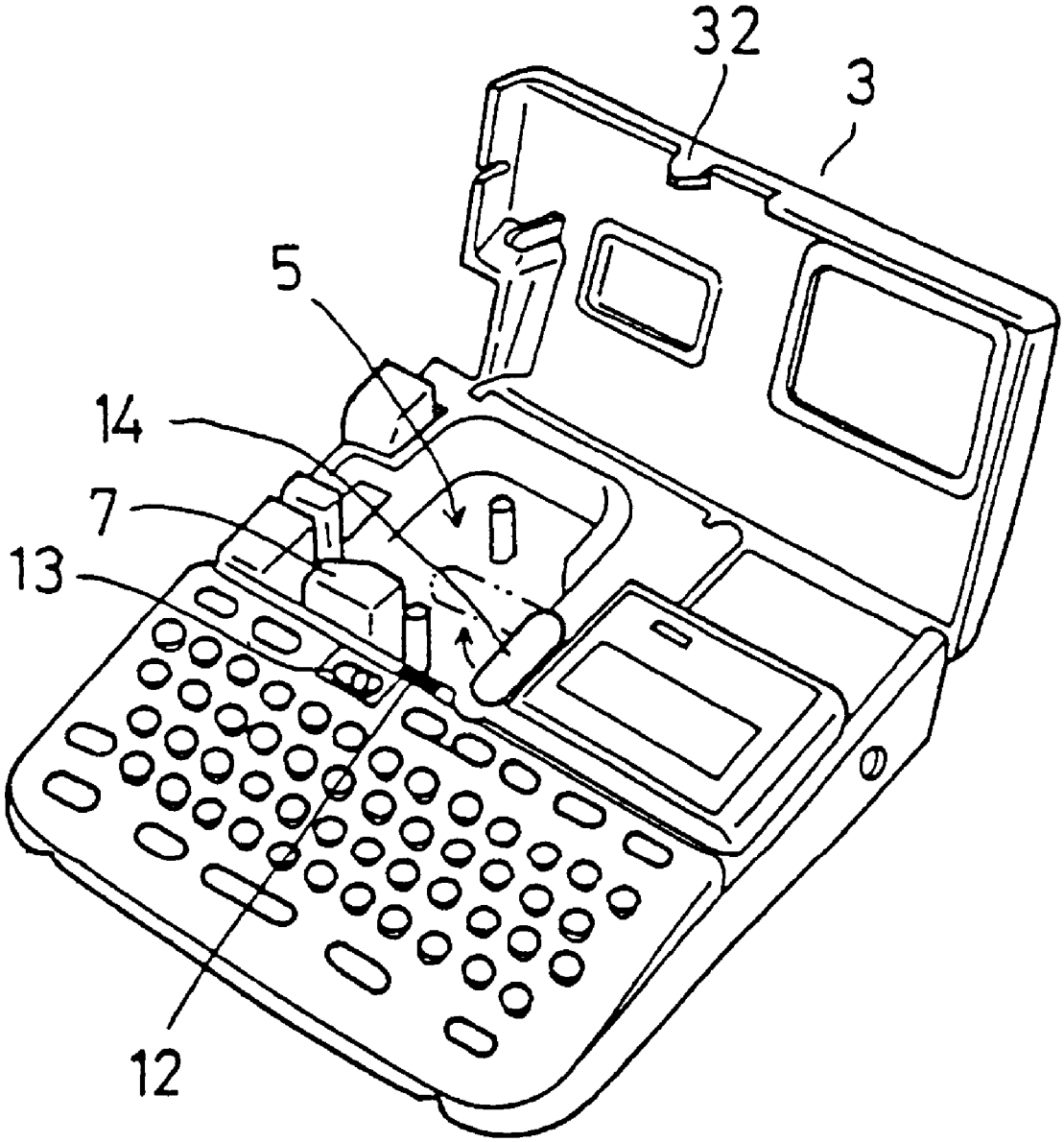
Fig. 13 (PRIOR ART)
FIG. 13 is an external view of a printer for illustrating another example of a conventional head release mechanism for printer.

FIG. 2 shows the condition in which cover 22 is opened. On one side of the part of system unit 23 that is exposed when cover 22 is opened, cartridge-mounting unit 25 is formed to mount tape cartridge on a detachable basis. Placed on the other side is display surface 26 that displays input characters. Tape cartridge 4 is identical to what is shown in FIGS. 11B and 12.

The following items protrude vertically from the bottom of cartridge-mounting unit 25: a head unit 7, into which thermal head 6 is built in; a platen roll axis 27; a ribbon take-up axis 28, a tape roll axis 29, and so forth. A unit that accommodates these items is formed on the side of tape cartridge 4. In a condition in which tape cartridge 4 is mounted on mounting unit 24, these units 7 and axes 26 through 28 are inserted into the corresponding units that are formed on the side of tape cartridge 4, thus making possible printing operations on tape-form recording medium T that is built into tape cartridge 4. Because these mechanisms are identical to conventional mechanisms (see FIGS. 11B and 12), a further description of the mechanisms is omitted.

In this example, hook 31, for locking the cover, is formed at a position adjacent to cut-out 22*a* on the front edge of cover 22. Insertion hole 32 of hook 31 is formed on the side of system unit 23. Further, lip 22*b*, extending from cut-out 22*a* to the rear edge, is formed at the center of the backside of cover 22. Protrusion 51, extending more or less vertically from the backside of the cover, is formed at the center of that side. Insertion hole 52 of protrusion 51 is formed on the side of system unit 23. Protrusion 51 is a constituent element of the head release mechanism of the present example.

Figure 3:
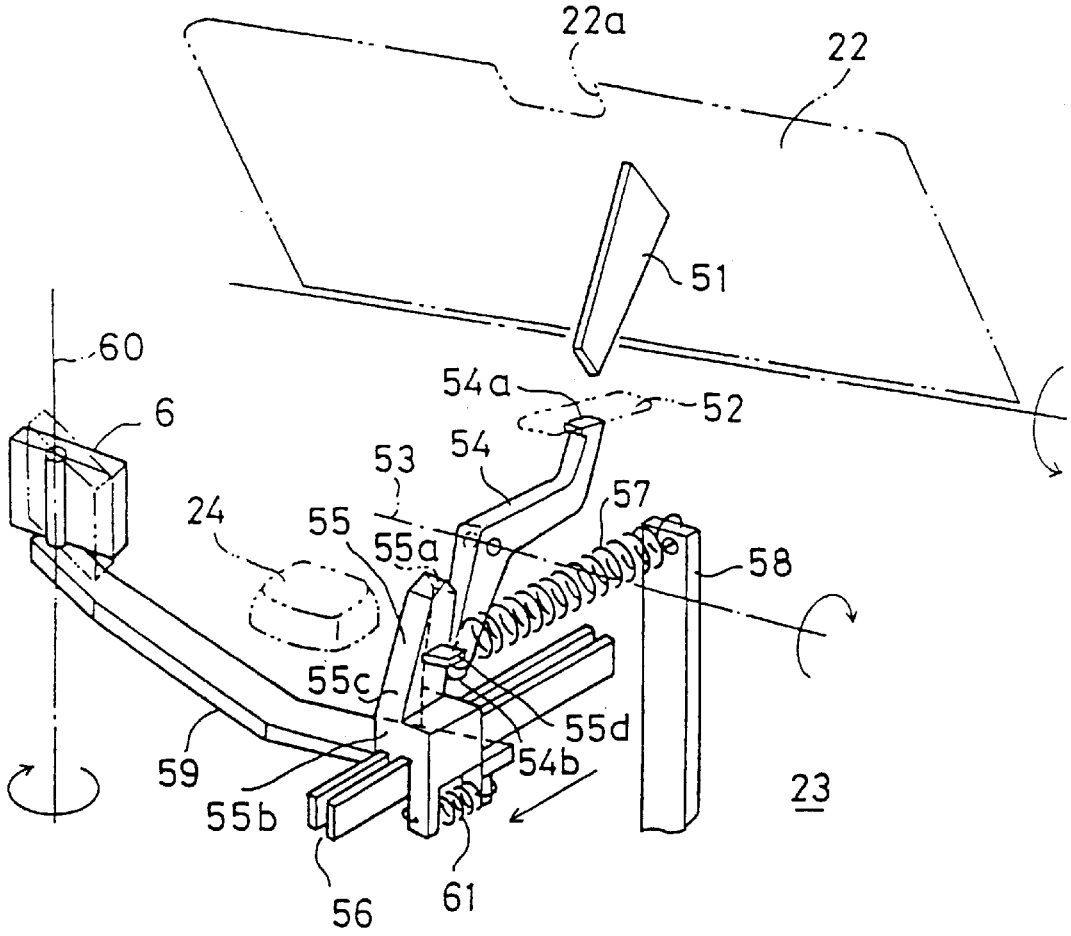
FIG. 3 is a schematic diagram of the head release mechanism that is incorporated into the printer of FIG. 1.
Figure 4A:
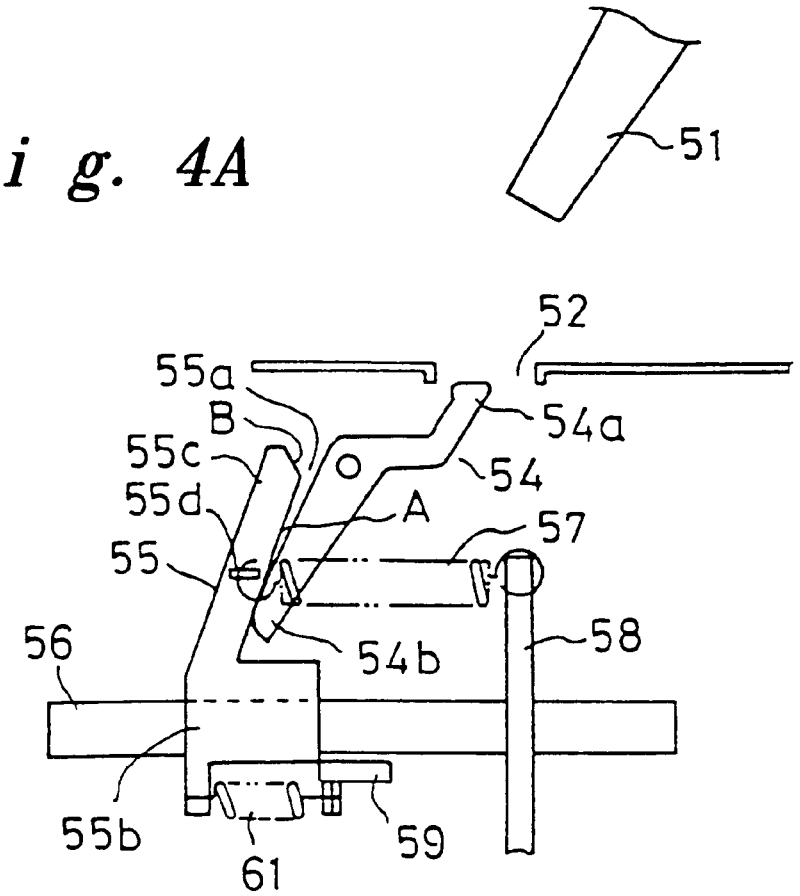
FIG. 4A is a schematic lateral-view diagram of the head release mechanism of FIG. 3.
Figure 4B:
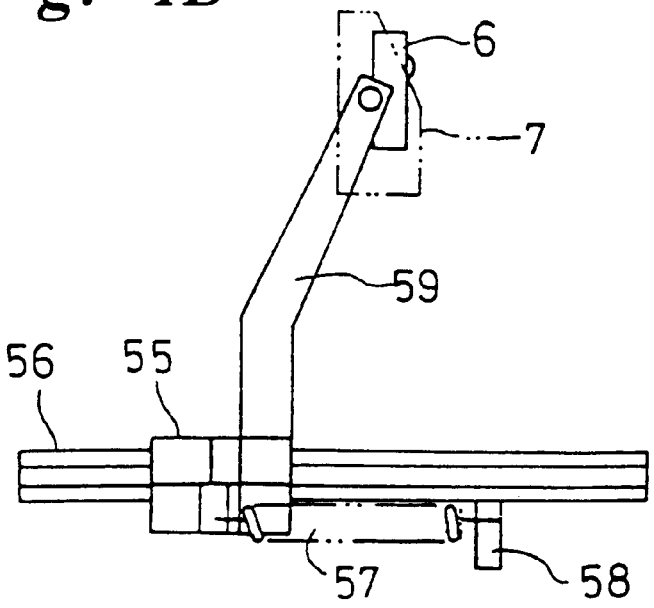
FIG. 4B shows a schematic planar diagram of the same.

The following is an explanation of the head release mechanism incorporated into printer 20 of the present example. As shown in FIGS. 3, 4A and 4B, in the interior of printer system unit 23, a rotary component 54 is provided on the backside of insertion hole 52 of protrusion 51 on cover 22, such that the rotary component is held in a rotatable condition around axial line 53. In rotary component 54, the arm that extends from axial line 53 to the side of insertion hole 52 is approximately L-shaped. Tip 54*a* of the arm is set at the coupling edge of protrusion 51. When protrusion 51 pushes in interlocking edge 54*a*, rotary component 54 rotates around axial line 53, and operating edge 54*b* at the other end rotates upward from the first position shown in the figure.

The operating edge 54*b* of rotary component 54 is always pressed against the coupling surface 55*a* of moving component 55. Moving component 55 is supported in such a way that it can move back and forth on the place orthogonal to axial line 53 of rotary component 54. Specifically, the moving component is composed of a seating unit 55*b*, capable of moving back and forth along guide rail 56, and a coupling unit 55*c* that protrudes from the top surface of seating unit 55*b*. The front face of coupling unit 55*c* is aforementioned coupling surface 55*a*. On the lateral side of coupling unit 55*c*, a spring coupling protrusion 55*d* is formed, to which one end of head release coil spring 57 is attached. Coil spring 57 is arranged parallel to guide rail 56. The other end is attached to spring receptacle 58 that is located at a fixed position. Therefore, moving component 55 is always pulled by coil spring 57 toward rotary component 54.

Head carrier component 59 is provided on the backside of seating unit 55*b* of moving component 55. This head carrier component 59 is provided in such a way that it can rotate around rotary axial line 60 located at its tip. Rotary axial line 60 is oriented in a direction orthogonal to rotary axial line 53 of rotary component 54. Thermal head 6 is attached to the tip of the top side of head carrier component 59 in such a way that it coincides with rotary axial line 60. Head heat generators are arranged up and down along the front side of thermal head 6. When head carrier component 59 rotates around axial line 60, thermal head 6 rotates in an integral manner from the position indicated by the solid line in the figure to the position indicated by the dashed lines in the figure. The position indicated by the solid line is the release position; the position indicated by the dashed lines is the print position.

The base tip side of head carrier component 59 extends to the backside of seating unit 55*b* of moving component 55. Coil spring 61 links the base edge of head carrier component 58 with seating unit 55*b* of moving component 55, such that head carrier component 59 rotates around its rotary axial line 60 in conjunction with the movement of moving component 55.

In the head release mechanism of this constitution, whenever cover 22 is closed, protrusion 51, that is formed integrally on the cover, pushes down the coupling edge 54*a* of rotary component 54. When cover 22 is completely closed, hook 31 is locked by the locking mechanism (e.g. FIGS. 8A and 8B) formed on the side of the printer system unit. When rotary component 54 rotates, moving component 55 is pressed toward the front side of the printer by operating edge 54*b* along guide rail 56.

Figure 5:
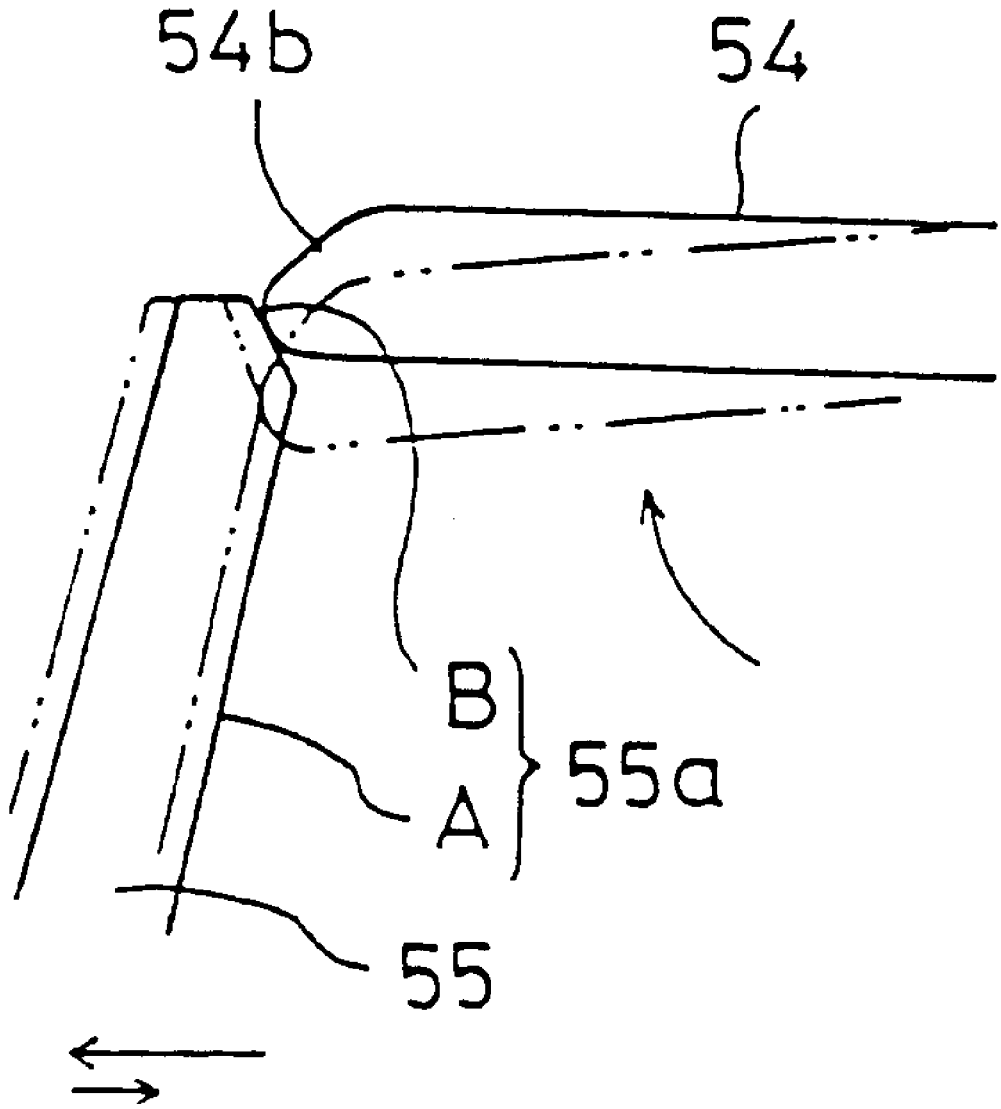
FIG. 5 is an explanatory diagram that shows the coupling relationship between the operating edge of the rotary component that composes the head release mechanism of FIG. 3 and the moving component.

This section explains the shape of the tip of operating edge 54*b* of rotary component 54 and the shape of coupling surface 55*a* of moving component 55 to which the tip of the operating edge is pressed. FIG. 5 shows an enlarged view of these coupling units. As shown in the figure, coupling surface 55*a* of moving component 55, except for its top edge, forms inclined surface A that inclines to the side of rotary component 54. The top edge, on the contrary, forms inclined surface B that inclines in the opposite direction. Therefore, when the operating edge 54*b* of the rotary component rotates along the lower-side inclined surface A, a force from moving component 55 acts on rotary component 54 in the direction that will rotate the rotary component 54 to the lower side shown in the figure. However, when the operating edge moves over the top edge of inclined surface A and comes into contact with inclined surface B, the force from moving component 55 acts on rotary component 54 in such a way that it rotates rotary component 54 to the top side as shown in the figure. Therefore, when the operating edge 54*b* of rotary component 54 moves over the top edge of inclined surface A, rotary component 54 rotates upward along inclined surface B even if it is not pressed by protrusion 51 of cover 22. If a limit on the upward rotation of rotary component 54 is set, rotary component 54 is fixed in that position.

In the present example, in a condition in which cover 22 is completely closed, the rotary component is set in such a way that the operating edge 54*b* of rotary component 54 moves over the top edge of inclined surface A of moving component 55 by means of the action of protrusion 51. Therefore, after cover 22 is completely closed, rotary component 54 separates from protrusion 51 of the cover and rotates, due to the spring force of head release coil spring 57, from the dashed line position shown in FIG. 5 to the second position of the rotation limit indicated by the solid line. In this manner, inclined surface B of moving component 55 functions as a guide-holding surface for rotary component 54.

Figure 6:
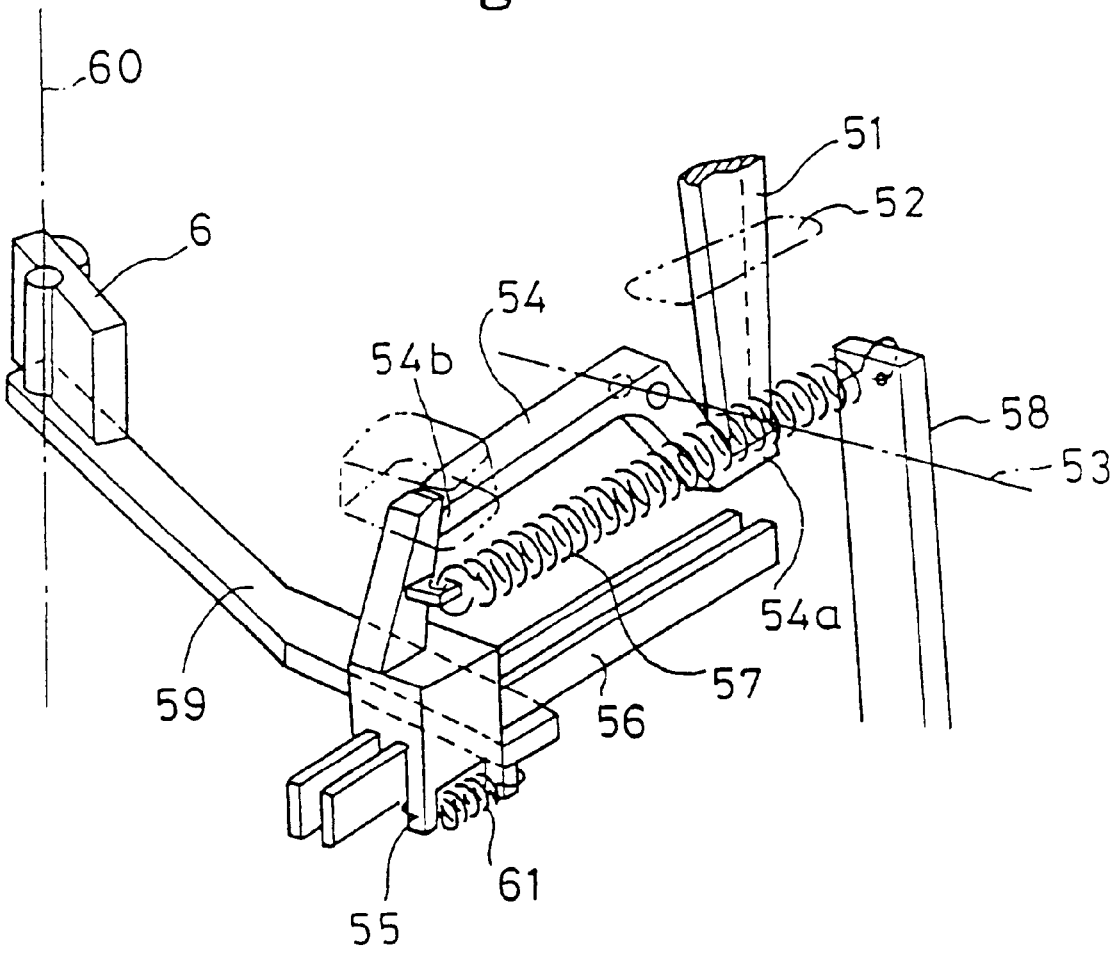
FIG. 6 is a schematic diagram showing the geometric relationship between the components in which the head in the head release mechanism of FIG. 3 is set at the print position.
Figure 7A:
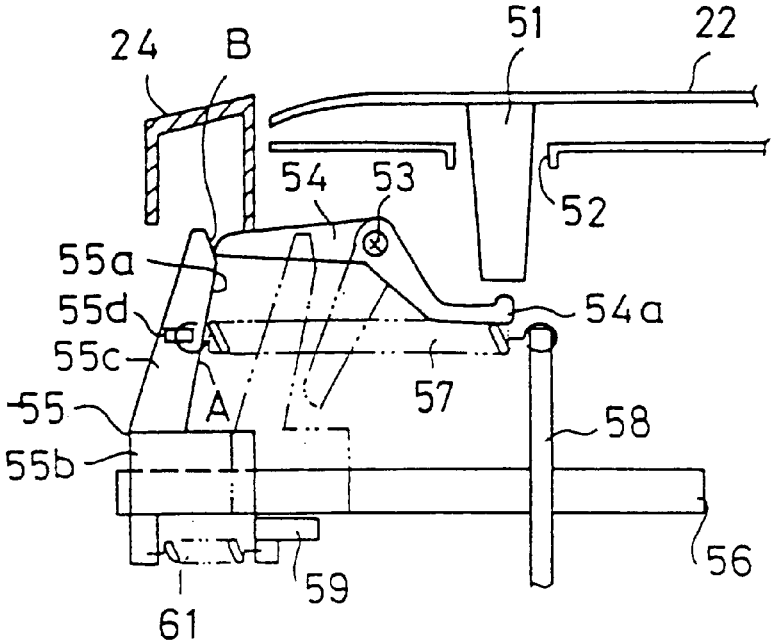
FIG. 7(*a*) is a schematic lateral-view diagram of the head release mechanism in the condition described in FIG. 5.
FIG. 7B is a schematic planar diagram of the same.
Figure 7B:
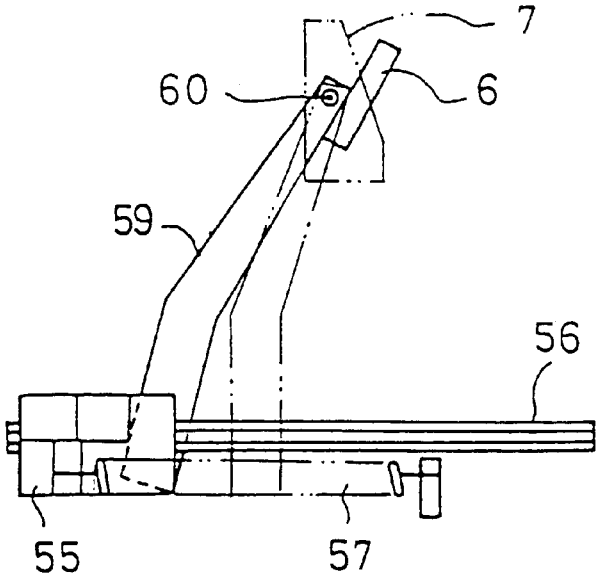

FIGS. 6 and 7A–7B show the geometric relationship between the components that compose the head release mechanism in a condition in which cover 22 is completely closed. In this state, the side of operating edge 54*b* of rotary component 54 assumes an almost horizontal orientation. Moving component 55, pushed by operating edge 54*b*, moves against the spring force of coil spring 57, and is in a state in which it has rotated head carrier component 59, which is attached there, to the print position. Head 6 supported by head carrier component 59 is set in the print position. As noted above, the coupling edge 54*a* of rotary component 54 is located away from the top of protrusion 51 of cover 22. Therefore, in this condition of the print position, protrusion 51 of cover 22 is physically separate from any other constituent elements of the head release mechanism. Consequently, no force acts on cover 22 from the side of head 6.

To retract the head to its release position after the head is set in the print position, one can simply push down cover-opening button 24. Thus, in this example, as shown clearly in FIGS. 6 and 7A–7B, cover-opening button 24 is provided so that it is positioned directly above the coupling surface 55*a* for operating edge 54*b* and moving component 55. When cover-opening button 24 is pushed down in order to open cover 24, operating edge 54*b* is also forcibly pressed downward by the lower edge surface 24*b* of the button. This causes operating edge 54*b* to move over the lower edge of inclined surface B to move to inclined surface A. After that, the action of coil spring 57 causes rotary component 54 to rotate toward the first position, as moving component 55 moves, and to return to the released state shown in FIGS. 3 and 4. As moving component 55 moves, head carrier component 59 also rotates, and this causes head 6, supported on the tip of the head carrier component, to return to the released state.

Thus, the lower edge surface 24*a* of cover-opening button 24 functions as an unlocking surface that releases the operating edge 54*b* of rotary component 54 from the second position so that it can rotate toward the first position.

Figure 8A:
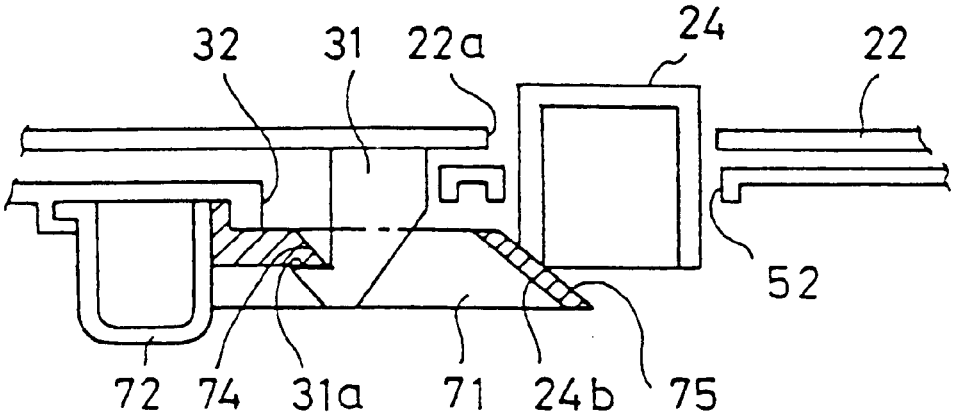
FIGS. 8A and 8B shows the cover-locking mechanism that is incorporated in to the printer of FIG. 1 where.
Figure 8B:
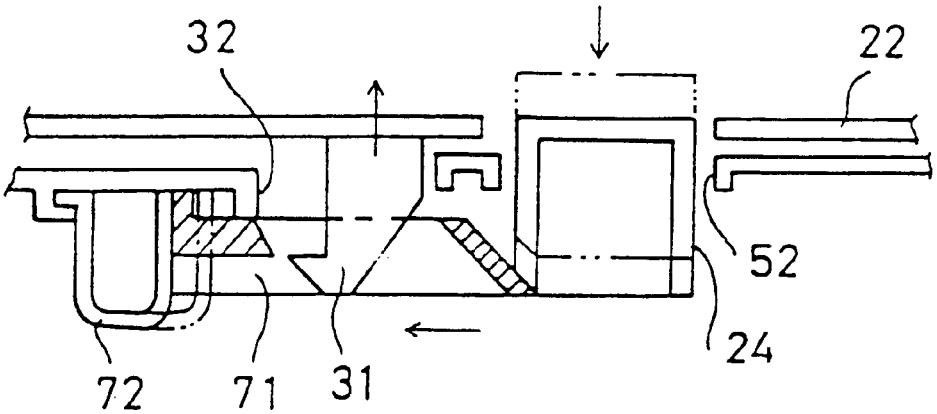

The following is an explanation of the cover locking mechanism of the present example with reference to FIGS. 8A and 8B. As shown in the figure, hook-coupling component 71 is attached to the lower side of hole 32, into which hook 31 of cover 22 is inserted. Coupling unit 71, while being supported in such a way that it can move right and left, is always pressed toward the side of hole 32 by a U-shaped spring unit 72 that is formed on one edge. On coupling component 71, hole 73 into which hook 31 can be inserted is formed at a position opposite hole 32. Hook-coupling surface 74 is formed on one edge of hole 73. The tip of hook 73 is butted against coupling surface 74, and is inserted into the hole in such a way that the coupling surface is pressed in a horizontal direction. When hook 31 is completely inserted, a condition is formed in which the coupling surface 31*a* of hook 31 is coupled to the backside of coupling surface 74.

Button-coupling surface 75, coupled to the lower edge surface 24*b* of cover-opening button 24, is formed on coupling component 71. When button 24 is pressed, coupling component 71 is forcibly pressed sideways. When coupling component 71 is pressed sideways, coupling surface 74, formed on the coupling component, disconnects from hook 31. This is shown in FIG. 8B. Since cover 22 is always energized in the opening direction by methods that are the public domain, such as screw springs, the cover opens automatically when the lock is released. When the pressing down action on button 24 ceases, coupling component 71 moves horizontally and is returned to is original position by the spring force of spring unit 72 of coupling component 71. Further, coupling component 71 also pushes button 24. This causes the button to move upward and return to its original, protruding position.

Preferred Embodiment 2

Figure 9B:
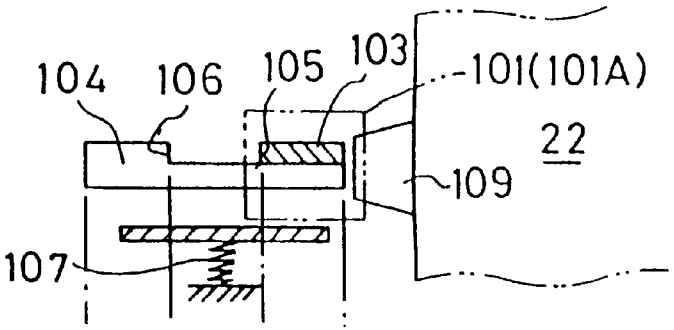
FIG. 9 illustrates another example of a head release mechanism according to the present invention in which (A) shows a schematic diagram of the mechanism and (B) illustrates the shape of a groove for sliding the cover-opening button.
Figure 9A:
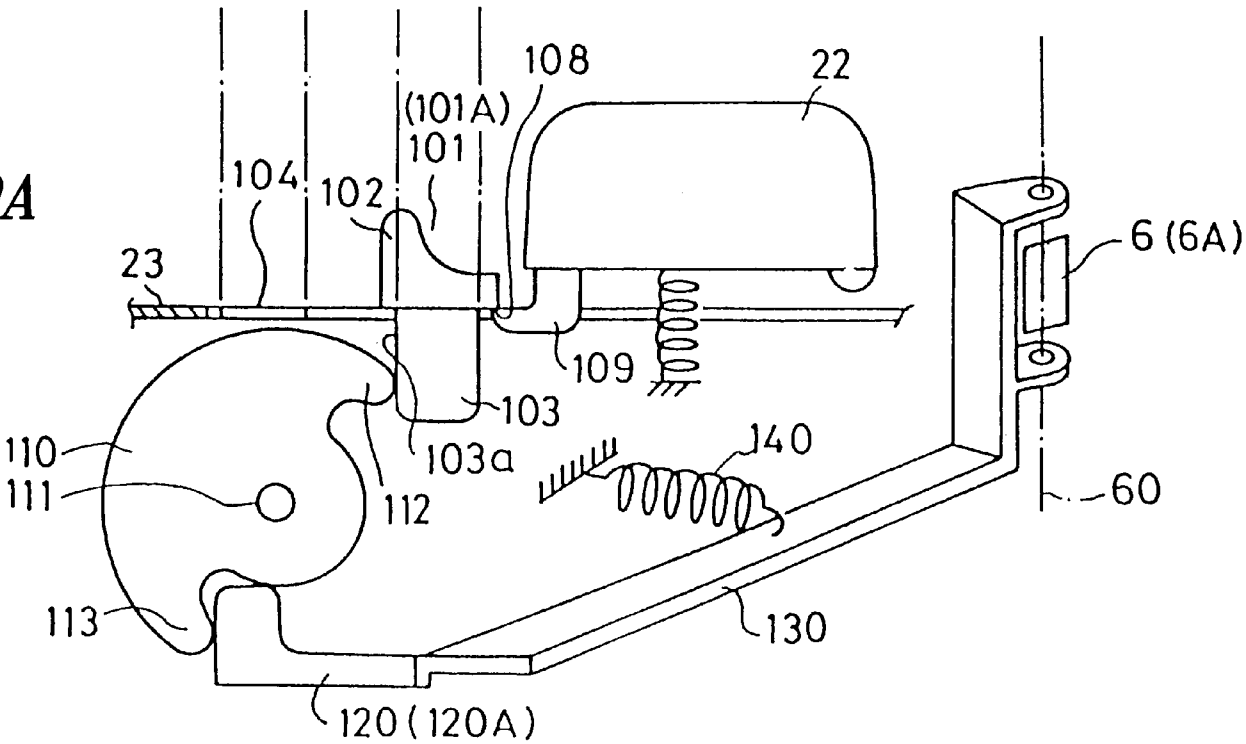
Figures 10A, 10B:
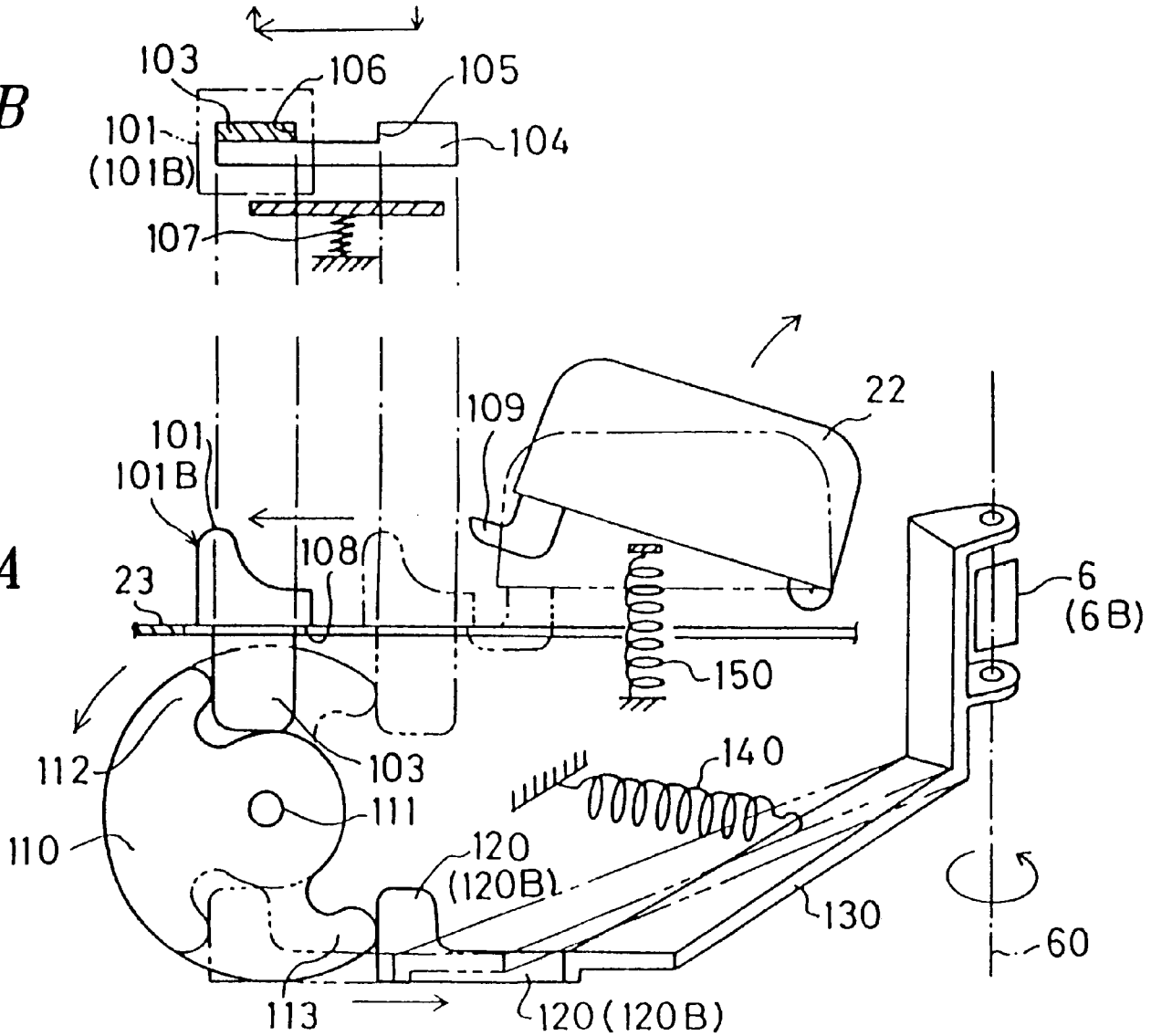
FIG. 10 illustrates the head release mechanism shown in FIG. 9 in a state where the cover-opening button is slid into the cover open position in which (A) refers to a schematic diagram for showing the movement of each component in that state and (B) shows the position of the cover-opening button in the sliding groove.

FIGS. 9 and 10 show another example of the head release mechanism structure according to the present invention. The head release mechanism shown in these figures is applicable to printer 20 whose entire structure is shown in FIGS. 1 and 2. In such cases, protrusion 51 formed on the back side of cover 22 and hole 52 into which the protrusion goes would not be necessary. Also, hook 31 formed on cover 22 and a lock mechanism with which hook 31 engages (see FIG. 8) would not be necessary. Since the structure is identical except for these components, only a structure of the head release mechanism will be discussed below and the entire structure of a printer will not be discussed.

The head release mechanism according to this embodiment has a cover-opening button 101 which can slide along the upper surface of body 23. The cover-opening button 101 is equivalent to cover-opening button 24 of the previous embodiment. A cover-opening button 101 of this embodiment includes a head 102 provided for operation conducted with fingers by an operator and a laminar leg 103 extending downward from the back side of the head. The cover-opening button 101 in this structure can slide between cover locked position 101A adjacent to the front edge of a cover 22 (indicated by a solid line in the figure) and cover open position 101B indicated by a solid line in FIG. 10, along slide groove 104 formed in body 23. Slide groove 104 has coupling surfaces 105 and 106 formed therein, which allows leg 103 of cover-opening button 101 to engage with coupling surface 105 at cover locked position 101A and coupling surface 106 at cover open position 101B. Cover-opening button 101 is energized by spring 107 in the direction such that the engagement with each of coupling surfaces 105 and 106 can be held.

A overhanging lip 108 is formed between head 102 and leg 103 in cover-opening button 101. Hooking claw 109 formed on the front edge of cover 22 can engage with lip 108 from the lower side. FIG. 9 shows a state in which cover-opening button 101 is at cover locked position 101A as indicated by a solid line, which presents a state in which the cover's hooking claw 109 is engaged with lip 108 of cover-opening button 101. That is, cover 22 is in a locked state.

Inside of body 23 is disposed rotary cam 110 in a manner that the cam can rotate around rotary axial line 111 which extends horizontally. Upper hooking protrusion 112 of rotary cam 110 projects toward cover 22 to be kept in contact with a side 103*a* of leg 103 of said cover-opening button 101 opposing to cover 22. Therefore, when cover-opening button 101 is slid toward cover open position 101B, leg 103 rotates rotary cam 110 counterclockwise, facing to the drawing.

Lower hooking protrusion 113 of rotary cam 110 projects in the same direction as upper hooking protrusion 112 to be kept in contact with interlocking member 120. Interlocking member 120 is disposed so that it can slide between position 120A as indicated by a solid line in FIG. 9 and position 120B as indicated by a solid line in FIG. 10. Therefore, when rotary cam 110 rotates anti-clockwise, interlocking member 120 is pushed by lower hooking protrusion 113 and thus slides toward position 120B.

The other side of interlocking member 120 is kept in contact with the base edge of head carrier member 130 that carries print head 6 at the tip. Head carrier member 130 performs the same function as head carrier member 59 as described with reference to Embodiment 1 (see FIG. 3). That is, head carrier member 130 carries the print head 6 such that it can rotate print head 6 around rotary axial line 60 to be at print position 6A as indicated by a solid line in FIG. 9 and at release position 6B as indicated by a solid line in FIG. 10.

Head carrier member 130 is always pulled at the middle of it by head pressure spring 140 toward the direction of rotating print head 6 to print position 6A. The spring force of this spring allows head carrier member 130 and interlocking member 120 to be kept in contact, interlocking member 120 and lower hook protrusion 113 of rotary cam 110 to be kept in contact, and upper hook protrusion 112 of rotary cam 110 and leg 103 of cover-opening button 101 to be kept in contact.

Further, cover 22 is always pressed into the direction of opening by pop-up spring 150. Therefore, hooking claw 109 of cover 22 is pressed against lip 108 of cover-opening button 101 from the lower side through the spring force.

Now, the operation of a head release mechanism constructed in this manner will be discussed. In a state in which cover 22 is locked as shown in FIG. 9, when cover-opening button 101 moves slightly against the spring force of spring 107 in a direction orthogonal to the siding direction, leg 103 comes off coupling surface 105 of slide groove 104. Therefore, from this point on, cover-opening button 101 can be moved against the force of head pressure spring 140 toward cover open position 101B along slide groove 104.

When cover opening button 101 is moved along slide groove 104, lip 108 comes off hooking claw 109 of cover 22. Consequently, cover 22 opens automatically through the force of pop-up spring 150.

When cover-opening button 101 is moved to the cover open position 101B, cover-opening button 101 is pushed in a direction orthogonal to the sliding direction by the spring force of spring 107 to engage leg 103 with coupling surface 106. As a result, cover-opening button 101 is to be held at cover open position 101B.

When cover-opening button 101 slides, leg 103 allows rotary cam 110 to rotate anti-clockwise. As a result, rotary cam 110 allows interlocking member 120 to move from position 120A to position 120B. This allows head carrier member 130 to rotate around rotary axis 60, which in turn allows print head 6 held at the tip to rotate from print position 6A to release position 6B and to be held there.

Thus, in a head release mechanism according to this embodiment, cover 22 can be moved to its release position in conjunction with the operation of opening cover 22.

In order to put print head 6 back to print position 6A, the operation in reverse to the foregoing may be performed. That is, cover 22 is closed, and cover-opening button 101 is pushed slightly against the spring force of spring 107 in a direction orthogonal to the sliding direction while cover 22 remains closed. As a result, leg 103 of cover-opening button 101 comes off coupling surface 106 of slide groove 104. Then, by the force of head pressure string 140, head carrier member 130 rotates back to the previous position to have print head 6 returned to print position 6A. The movement of head carrier member 130 is communicated to cover-opening button 101 via interlocking member 120 and rotary cam 110 to push back cover-opening button 101 to cover locked position 101A. Cover-opening button 101 returned to cover locked position 101A goes into coupling surface 105 through the spring force of spring 107, and is held at cover locked position 101A. When reached at cover locked position 101A, lip 108 of cover-opening button 101 runs onto hooking claw 109 of cover 22 which is held in a closed state. Accordingly, cover 22 is now back in a locked state.

In a state in which cover 22 is locked, the spring force of head pressure spring 140 or load acting on print head 6 travels through head carrier member 130, interlocking member 120 and rotary cam 110 to reach cover-opening button 101. However, load passed onto cover-opening button 110 is supported by the inner rim of slide groove 104 formed in the body 23, and thus does not reach the side of cover 22. Accordingly, unlike a conventional method, such problems can be prevented as those occur when cover 22 supports load from a print head.

Applicability in the Art

As described above, the head release mechanism of the present invention permits the releasing of the print head by the unlocking of the cover. Further, in a condition in which the cover is completely closed and the print head is fixed in the print position, the side of the cover is held in a state in which it is physically separate from the other constituent elements of the head release mechanism. This prevents any force from acting on the cover side from the print head side.

Therefore, according to the present invention, in contrast to the conventional mechanism in which a cover is used as part of a head release mechanism, the cover neither becomes deformed because of the action of head load on it nor does the head load change due to a deformation of the cover. This ensures that the head load is maintained at an appropriate value.

Further, in contrast to conventional mechanisms in which independent head release operating components are employed, the head can be released in conjunction with the operation of opening the cover. This eliminate the need for separate head release operations and results in a simpler printer operation.

What is claimed is:

1. A printer head release mechanism for use in a printer defining a recess to releasably mount a recording medium cartridge therein and including a print head and a printer cover to cover the recording medium cartridge when the removable medium cartridge is mounted within the printer, the printer head release mechanism comprising:

a rotary member pivotable about a transverse axis thereof and including an operating arm and an opposing coupling arm to releasably engage the printer cover when the printer cover moves to cover the recording medium cartridge;

a head moving member in slidable frictional engagement with said operating arm of said rotary member and movable between a first position and a second position within the printer along a guide affixed to the printer proximate the printer recess when the printer cover moves to cover the recording medium cartridge;

a spring coupling said head moving member to a fixed spring receptacle within the printer proximate the printer guide and biasing said head moving member against said operating arm of said rotary member towards the first printer position; and a head carrier member coupled to said head moving member and the print head to position the print head away from the recording medium cartridge and bring the print head into contact with recording medium contained in the recording medium cartridge as said head moving member moves towards the second printer position.

2. The printer head release mechanism of claim 1, wherein the printer cover comprises an integral protrusion extending into frictional contact with said coupling arm of said rotary member when the printer cover moves to cover the recording medium cartridge which pivots said rotating member about said transverse axis and causes said operating arm of said rotating member to push said head moving member from the first printer position towards the second printer position.

3. The printer head release mechanism of claim 1, wherein said head moving member engages said operating arm of said rotary member along a coupling surface, said head moving member coupling surface including a first portion inclined toward said operating arm of said rotary member to induce movement of said head moving member toward said first position and an adjoining second portion inclined away from said operating arm of said rotary member to lockably engage said rotary member with said head moving member independent of the printer cover when said head moving member moves towards the second printer position.

4. The printer head release mechanism of claim 2, wherein said head moving member engages said operating arm of said rotary member along a coupling surface, said head moving member coupling surface including a first portion inclined toward said operating arm of said rotary member to induce movement of said head moving member toward said first position and an adjoining second portion inclined away from said operating arm of said rotary member to lockably engage said rotary member with said head moving member independent of the printer cover protrusion when said head moving member moves towards the second printer position.

5. A printer head release mechanism for use in a printer including a print head and an printer cover movable between open and closed positions, the printer head release mechanism comprising:

a rotary member pivotable about a transverse axis thereof and including an operating arm and an opposing coupling arm to releasably engage the printer cover when the printer cover is closed;

a head moving member in slidable frictional engagement with said operating arm of said rotary member and movable between a first position and a second position within the printer along a fixed guide when the printer cover is closed;

a spring coupling said head moving member to a fixed spring receptacle within the printer proximate the fixed guide and biasing said head moving member against said operating arm of said rotary member towards the first printer position; and a head carrier member coupled to said head moving member and the print head to position the print head away from recording medium contained in the printer and bring the print head into contact with the recording medium as said head moving member moves towards the second printer position.

6. The printer head release mechanism of claim 5, wherein the printer cover comprises an integral protrusion extending into frictional contact with said coupling arm of said rotary member when the printer cover is closed to pivot said rotating member about said transverse axis and cause said operating arm of said rotating member to push said head moving member from the first printer position towards the second printer position.

7. The printer head release mechanism of claim 5, wherein said head moving member engages said operating arm of said rotary member along a coupling surface, said head moving member coupling surface including a first portion inclined toward said operating arm of said rotary member to induce movement of said head moving member toward said first position and an adjoining second portion inclined away from said operating arm of said rotary member to lockably engage said rotary member with said head moving member independent of the printer cover when said head moving member moves towards the second printer position.

8. The printer head release mechanism of claim 6, wherein said head moving member engages said operating arm of said rotary member along a coupling surface, said head moving member coupling surface including a first portion inclined toward said operating arm of said rotary member to induce movement of said head moving member toward said first position and an adjoining second portion inclined away from said operating arm of said rotary member to lockably engage said rotary member with said head moving member independent of the printer cover protrusion when said head moving member moves towards the second printer position.

9. A printer for printing information on recording a medium stored therein, comprising:

an external cover movable between open and closed positions for accessing said recording medium;

a print head in releasable communication with said recording medium; and a printer head release mechanism in communication with said print head, comprising:

a rotary member pivotable about a transverse axis thereof and including an operating arm and an opposing coupling arm to releasably engage said external cover when said external cover is closed;

a head moving member in slidable frictional engagement with said operating arm of said rotary member and movable between a first position and a second position within the printer along a fixed guide when said external cover is closed;

a spring coupling said head moving member to a fixed spring receptacle within the printer proximate said fixed guide and biasing said head moving member against said operating arm of said rotary member towards the first printer position; and a head carrier member coupled to said head moving member and said print head to position said print head away from said recording medium and bring said print head into contact with said recording medium as said head moving member moves towards the second printer position.

10. The printer of claim 9, wherein said external cover comprises an integral protrusion extending into frictional contact with said coupling arm of said rotary member when said external cover is closed to pivot said rotating member about said transverse axis and cause said operating arm of said rotating member to push said head moving member from the first printer position towards the second printer position.

11. The printer of claim 9, wherein said head moving member engages said operating arm of said rotary member along a coupling surface, said head moving member coupling surface including a first portion inclined toward said operating arm of said rotary member to induce movement of said head moving member toward said first position and an adjoining second portion inclined away from said operating arm of said rotary member to lockably engage said rotary member with said head moving member independent of said external cover when said head moving member moves towards the second printer position.

12. The printer of claim 10, wherein said head moving member engages said operating arm of said rotary member along a coupling surface, said head moving member coupling surface including a first portion inclined toward said operating arm of said rotary member to induce movement of said head moving member toward said first position and an adjoining second portion inclined away from said operating arm of said rotary member to lockably engage said rotary member with said head moving member independent of said external cover protrusion when said head moving member moves towards the second printer position.

* * * * *

UNITED STATES PATENT AND TRADEMARK OFFICE

CERTIFICATE OF CORRECTION

PATENT NO. : 6,113,292

DATED : September 5, 2000

INVENTOR(S) : Teruhiko Unno; Akira Hashimoto; Kenji Watanabe; Takanobu Kameda; Chieko Aida; Tomoyuki Shimmura It is certified that error appears in the above-identified patent and that said Letters Patent is hereby corrected as shown below:

Front page, Col. 1, section (73) ASSIGNEE, please add King Jim Co., Ltd.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*